US010326214B2

(12) United States Patent
Ju

(10) Patent No.: US 10,326,214 B2
(45) Date of Patent: Jun. 18, 2019

(54) CABLE CONNECTOR ASSEMBLY

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 63 days.

(21) Appl. No.: 15/828,890

(22) Filed: Dec. 1, 2017

(65) Prior Publication Data

US 2018/0166797 A1 Jun. 14, 2018

(30) Foreign Application Priority Data

Dec. 8, 2016 (CN) ..... 2016 2 1337654 U

(51) Int. Cl.

| | |
|---|---|
| ***H01R 24/00*** | (2011.01) |
| ***H01R 4/02*** | (2006.01) |
| ***H01R 13/627*** | (2006.01) |
| ***H01R 13/6581*** | (2011.01) |
| ***H01R 24/22*** | (2011.01) |
| ***H01R 13/6597*** | (2011.01) |
| ***H01R 24/60*** | (2011.01) |
| *H01R 107/00* | (2006.01) |
| *H01R 13/405* | (2006.01) |

(52) U.S. Cl.

CPC ..... *H01R 4/023* (2013.01); *H01R 13/6273* (2013.01); *H01R 13/6581* (2013.01); *H01R 13/6597* (2013.01); *H01R 24/22* (2013.01); *H01R 24/60* (2013.01); *H01R 13/405* (2013.01); *H01R 2107/00* (2013.01)

(58) Field of Classification Search

CPC ..... H01R 24/60

USPC ..... 439/660, 874

See application file for complete search history.

(56) References Cited

U.S. PATENT DOCUMENTS

| | | | | |
|---|---|---|---|---|
| 5,314,361 | A * | 5/1994 | Ney | H01R 4/027 439/874 |
| 9,300,095 | B2 * | 3/2016 | Lin | H01R 24/60 |
| 9,350,121 | B2 * | 5/2016 | Ju | H01R 13/6585 |
| 9,385,438 | B2 * | 7/2016 | Wu | H01R 4/023 |
| 9,515,439 | B2 * | 12/2016 | Ng | H01R 24/70 |
| 9,520,677 | B2 * | 12/2016 | Cheng | H01R 13/631 |

(Continued)

FOREIGN PATENT DOCUMENTS

| | | |
|---|---|---|
| CN | 204992025 U | 1/2016 |
| CN | 205264920 U | 5/2016 |

(Continued)

*Primary Examiner* — Neil Abrams

(74) *Attorney, Agent, or Firm* — Locke Lord LLP; Tim Tingkang Xia, Esq.

(57) ABSTRACT

A cable connector assembly includes an insulating body and a cable. The insulating body includes a first terminal group and a second terminal group received in the insulating body. The first terminal group has a first terminal. The first terminal has a first soldering surface at one end thereof. The second terminal group has a second terminal. The second terminal has a second soldering surface disposed opposite to the first soldering surface. The cable has a first core wire disposed between the first soldering surface and the second soldering surface and soldered to the first soldering surface and the second soldering surface. The first terminal and the second terminal have same functions share the first core wire and are directly soldered to the first core wire.

20 Claims, 8 Drawing Sheets

(56) References Cited

U.S. PATENT DOCUMENTS

| | | | | |
|---|---|---|---|---|
| 9,728,885 | B2 * | 8/2017 | Yokoyama | H01R 13/42 |
| 9,748,687 | B2 * | 8/2017 | Yokoyama | H01R 4/02 |
| 9,806,464 | B1 * | 10/2017 | Wang | H01R 13/6471 |
| 10,096,936 | B2 * | 10/2018 | Ju | H01R 13/6275 |
| 10,096,941 | B2 * | 10/2018 | Ju | H01R 13/631 |
| 10,103,491 | B2 * | 10/2018 | Ju | H01R 13/04 |
| 10,122,124 | B2 * | 11/2018 | Daughtry, Jr. | H01R 13/405 |
| 10,170,845 | B2 * | 1/2019 | Ju | H01R 24/22 |
| 10,170,867 | B2 * | 1/2019 | Ju | H01R 13/6585 |
| 10,218,088 | B2 * | 2/2019 | Chang | H01R 13/6586 |
| 2018/0166797 | A1 * | 6/2018 | Ju | H01R 13/6597 |

FOREIGN PATENT DOCUMENTS

| | | | |
|---|---|---|---|
| CN | 105633729 | A | 6/2016 |
| CN | 205282695 | U | 6/2016 |
| CN | 205565062 | U | 9/2016 |
| CN | 106058530 | A | 10/2016 |
| TW | 201616731 | A | 5/2016 |
| TW | M527626 | U | 8/2016 |

* cited by examiner

100

B–B

C–C

CABLE CONNECTOR ASSEMBLY

CROSS-REFERENCE TO RELATED APPLICATIONS

This non-provisional application claims priority to and benefit of, under 35 U.S.C. § 119(a), Patent Application No. 201621337654.4 filed in P.R. China on Dec. 8, 2016, the entire content of which is hereby incorporated by reference.

FIELD OF THE INVENTION

The present invention relates to a cable connector assembly, and more particularly to a cable connector assembly with terminals directly soldered to a cable.

BACKGROUND OF THE INVENTION

An existing cable connector assembly includes an insulating body, multiple terminals arranged on the insulating body, a metal shell wrapping the insulating body, and a cable having multiple core wires. Each core wire is correspondingly soldered to corresponding one of the terminals. However, because of a large number of terminals, the soldering procedure is complicated. Further, more core wires are needed for soldering, resulting in relatively high production cost. To solve the above-mentioned problems, those skilled in the art add a connecting piece to the insulating body, the terminals having same functions are connected using the connecting piece, and then the core wires are soldered onto one of the terminals or the connecting piece, so that multiple terminals having same functions can share one core wire. However, since the cable connector is small in size, the distance between the adjacent terminals is limited, and there is no sufficient space for arranging the connecting piece in the case of not changing the length and height of the cable connector. Moreover, the connecting piece is first in mechanical contact with the multiple terminals having same functions and then is soldered to the core wire, the poor contact is likely to occur when the connecting piece contacts the terminals, resulting in unstable electrical connection between the terminals and the cable. Furthermore, by adding the connecting piece, the manufacturing cost is even increased.

Therefore, a heretofore unaddressed need exists in the art to address the aforementioned deficiencies and inadequacies.

SUMMARY OF THE INVENTION

In one aspect, the present invention relates to a cable connector assembly that achieves objectives of production cost reduction and stable electrical connection between terminals and cables.

In certain embodiments, a cable connector assembly includes an electrical connector and a cable. The electrical connector includes an insulating body and a first terminal group and a second terminal group. The first terminal group and the second terminal group are respectively received in the insulating body and arranged in an upper row and a lower row on the insulating body. The first terminal group includes at least one first terminal. The first terminal has a first contacting portion in one end, and a first soldering portion in the other end. The first soldering portion has a first soldering surface. The second terminal group includes at least one second terminal. The second terminal has a second contacting portion in one end, and a second soldering portion in the other end. The second soldering portion has a second soldering surface disposed opposite to the first soldering surface. The cable has multiple core wires soldered to the first terminal group and the second terminal group. The cable has at least one first core wire disposed between the first soldering surface and the second soldering surface, and soldered to the first soldering surface and the second soldering surface.

In certain embodiments, the first terminal group and the second terminal group both have multiple signal terminals, and a distance between the first soldering surface and the second soldering surface is smaller than a distance between one of the signal terminals of the first terminal group and corresponding one of the signal terminals in the second terminal group.

In certain embodiments, the second terminal is in alignment with the first terminal in the vertical direction, the second terminal and the first terminal are both power terminals, and the first core wire is a power wire.

In certain embodiments, the first soldering surface and the second soldering surface urge against two sides of the first core wire along a horizontal direction, and projections of the first soldering surface and the second soldering surface in the horizontal direction are partially overlapped.

In certain embodiments, the first terminal group and an upper insulating block are integrated by insert molding, the second terminal group and a lower insulating block are integrated by insert molding, the rear end of the insulating body is recessed forward with a receiving cavity, and the upper insulating block and the lower insulating block are installed together and then assembled into the receiving cavity to form a placement platform protruding out of the rear end of the receiving cavity. The multiple core wires are divided into two rows to be respectively distributed on the upper surface and the lower surface of the placement platform so as to be soldered to the first terminal group and the second terminal group, and the first core wire is disposed between the two rows of core wires and soldered to the first soldering surface and the second soldering surface.

In certain embodiments, the placement platform is provided with at least one open slot along the front-rear direction, the first soldering surface and the second soldering surface are both exposed to the open slot, and the first core wire is inserted into the open slot to be soldered to the first soldering surface and the second soldering surface.

In certain embodiments, the first terminal group and the second terminal group are each provided with at least one ground terminal and multiple signal terminals, and the cable also includes at least one ground wire and multiple signal wires. The upper surface and the lower surface of the placement platform are respectively recessed with multiple wire arrangement slots along the vertical direction, the multiple signal wires are correspondingly received in the multiple wire arrangement slots so as to be soldered to the multiple signal terminals, and the ground wire is disposed at the outer side of the placement platform so as to be soldered to the ground terminals.

In certain embodiments, the multiple signal terminals includes a first high-speed signal terminal adjacent to the ground terminal and a second high-speed signal terminal adjacent to the first high-speed signal terminal. The first high-speed signal terminal successively has a third contacting portion, a bending portion and a third soldering portion from front to rear. The bending portion and the third contacting portion are different in extending directions, and the bending portion and the third soldering portion are disposed on a same plane. The second high-speed signal terminal successively has a fourth contacting portion, a deviation portion, a reverse bending portion and a fourth soldering portion from front to rear. The deviation portion extends towards a direction close to a deflection direction of the bending portion, the reverse bending portion is deflected reversely from the deviation portion and disposed on a same plane with the deviation portion, and the third soldering portion and the fourth soldering portion are both disposed on the placement platform to be soldered to the signal wires.

In certain embodiments, the first terminal group and the second terminal group are each provided with two ground terminals. The front end of each ground terminal has a fifth contacting portion. The rear end has a fifth soldering portion and a transition portion disposed between the fifth contacting portion and the fifth soldering portion. The transition portion is deflected towards a direction away from the first high-speed signal terminal, and a deflection direction of the transition portion is opposite to a deflection direction of the reverse bending portion.

In certain embodiments, two sides of the upper insulating block and the lower insulating block are respectively transversely and convexly provided with a protruding portion, and each protruding portion correspondingly wraps and fixes the transition portion of each ground terminal.

In certain embodiments, the first terminal group and the second terminal group are each provided with at least one ground terminal. A latch member is arranged on the insulating body and disposed between the first terminal group and the second terminal group, and the ground terminals of the first terminal group and the second terminal group are respectively in electrical contact with the latch member.

In certain embodiments, a first metal shell is sleeved on the insulating body, one end of a second metal shell wraps the periphery of the first metal shell, the other end of the second metal shell wraps and fixes the cable, and the second metal shell urges against the ground terminal or/and the latch member. The cable also includes at least one ground wire, and the ground wire is soldered to at least one of the ground terminal, the latch member or the second metal shell.

In certain embodiments, the front end of the insulating body is concavely provided with an insertion cavity. The latch member has a pair of latch arms entering the insertion cavity. Each latch arm extends backward to form an elastic arm protruding out of the insulating body. A front section of the elastic arm urges against the ground terminals of the first terminal group and the second terminal group. A rear section of the elastic arm is convexly provided with a conducting portion elastically urging against the inner wall of the second metal shell. The ground wire is soldered to the second metal shell.

In another aspect, the present invention relates to a cable connector assembly. In certain embodiments, a cable connector assembly includes an electrical connector and a cable. The electrical connector includes an insulating body and at least one first terminal and at least one second terminal received in the insulating body. One end of the first terminal has a first contacting portion, the other end has a first soldering surface. One end of the second terminal has a second contacting portion, and the other end has a second soldering surface disposed opposite to the first soldering surface. The cable has at least one first core wire. The first core wire is disposed between the first soldering surface and the second soldering surface and soldered to the first soldering surface and the second soldering surface.

In certain embodiments, the front end of the insulating body is recessed backward with an insertion cavity. The first terminal and the second terminal are respectively disposed at the upper side and the lower side of the insertion cavity, and projections of the first soldering surface, the first core wire and the second soldering surface in the vertical direction are overlapped.

In certain embodiments, a plurality of signal terminals are arranged in an upper row and a lower row on the insulating body. A distance between the first soldering surface and the second soldering surface is smaller than a distance between the signal terminals disposed in the upper row and the signal terminals disposed in the lower row.

In certain embodiments, the rear side of the insulating body is convexly provided with a placement platform. The upper surface and the lower surface of the placement platform are respectively concavely provided with multiple wire arrangement slots along the vertical direction. The cable has multiple signal wires which are respectively disposed in the multiple wire arrangement slots so as to be correspondingly soldered to multiple signal terminals. The placement platform is provided with at least one open slot among the multiple wire arrangement slots. The first soldering surface and the second soldering surface are both exposed to the open slot, and the first core wire is inserted into the open slot to be soldered to the first soldering surface and the second soldering surface.

In certain embodiments, the front end of the insulating body is recessed backward with an insertion cavity. The first terminal and the second terminal are disposed at the same side of the insertion cavity. One side of the rear end of the first terminal is bent and extends to form a first extending sheet. The first extending sheet is provided with the first soldering surface. One side of the rear end of the second terminal is bent and extends towards the first extending sheet to form a second extending sheet. The second extending sheet is provided with the second soldering surface. The first core wire is horizontally disposed between the first soldering surface and the second soldering surface.

In certain embodiments, the number of the first terminals and the second terminals is respectively two. A first bridging portion is provided between the two first terminals. The two first terminals are connected into a whole by virtue of the first bridging portion. The first bridging portion is provided with the first soldering surface.

A second bridging portion is provided between the two second terminals. The two second terminals are connected into a whole by virtue of the second bridging portion. The second bridging portion is provided with the second soldering surface. The first core wire is disposed between the first bridging portion and the second bridging portion and soldered to the first soldering surface and the second soldering surface.

In certain embodiments, the second terminal and the first terminal are both power terminals and are in alignment with each other along the vertical direction, and the first core wire is a power wire.

Compared with the related art, certain embodiments of the present invention have the following beneficial advantages: the first core wire is disposed and soldered between the first soldering surface and the second soldering surface, and the first terminal and the second terminal having same functions share one core wire, so that not only can the number of the first core wire be reduced, but also no connecting piece is added for connecting the first terminal and the second terminal, thereby effectively decreasing the manufacturing cost of the cable connector assembly; moreover, the first terminal and the second terminal are directly soldered to the first core wire, so that the poor contact problem caused by allowing the first terminal and the second terminal to first contact each other and then to be soldered to the cable can be avoided, and an effect of stable electrical connection between the first terminal and the second terminal and the cable can be achieved.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
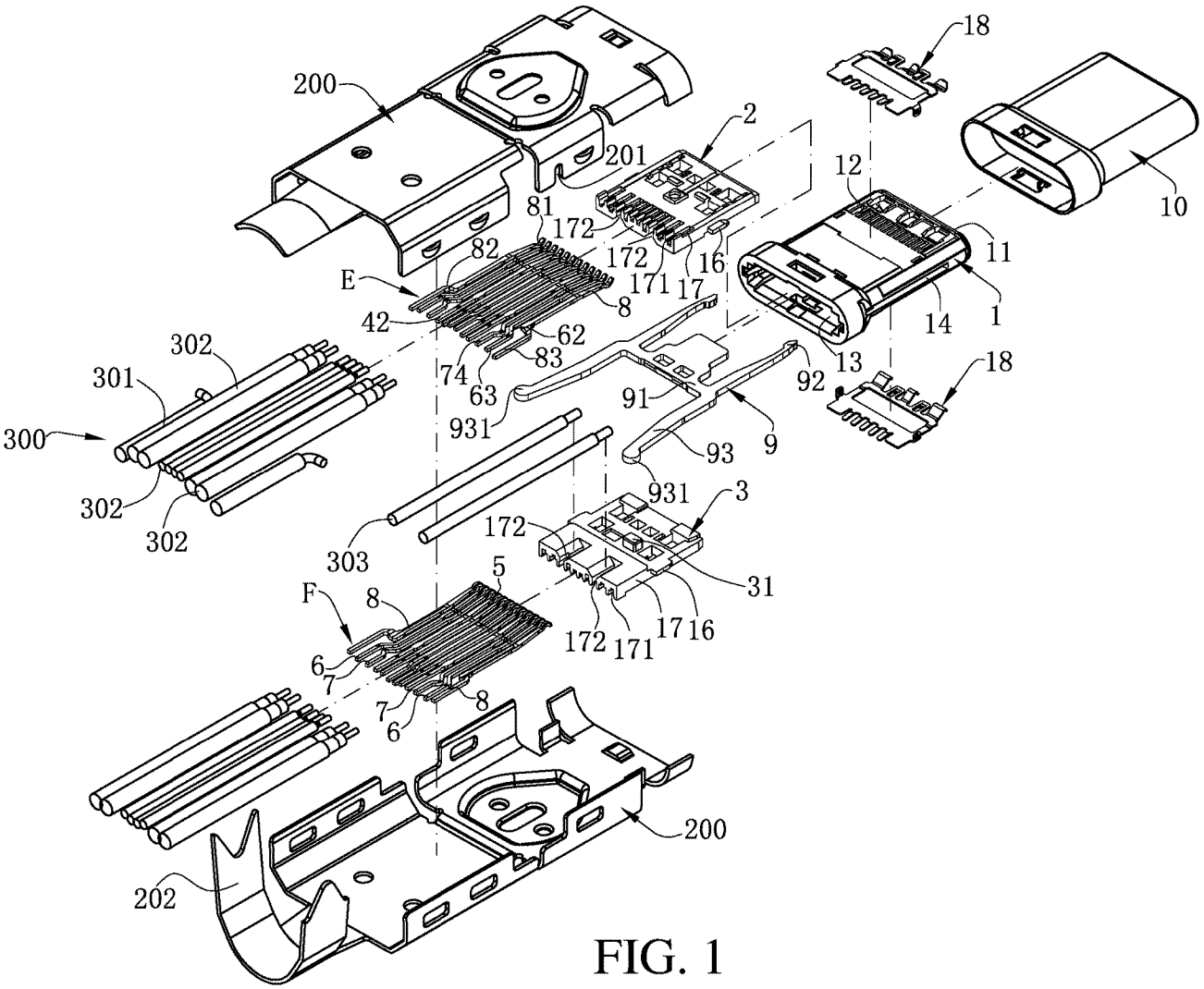
FIG. 1 is a schematic three-dimensional exploded view of a cable connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a cable electrical connector assembly.

As shown in FIG. 1 and, a cable connector assembly of the present invention includes an electrical connector 100 and a cable 300 electrically connected to the electrical connector 100. The electrical connector 100 is an electrical connection plug supporting high-speed data transmission. The electrical connector 100 and a connector socket (not shown) are mutually inserted. The electrical connector 100 includes an insulating body 1, a first terminal group E and a second terminal group F, a latch member 9, a first metal shell 10, and a second metal shell 200. The front end of the insulating body 1 has an insertion cavity 11 used for a tongue of the connector socket to be inserted therein. The rear end of the insulating body 1 is provided with a placement platform 17. The first terminal group E and the second terminal group F are received at the insulating body 1 and extend to the placement platform 17 so as to be soldered to the cable 300. The latch member 9 is arranged between the first terminal group E and the second terminal group F. The first metal shell 10 sleeves on the insulating body 1. One end of the second metal shell 200 wraps the periphery of the first metal shell 10, and the other end of the second metal shell 200 wraps and fixes the cable 300.

Figure 4:
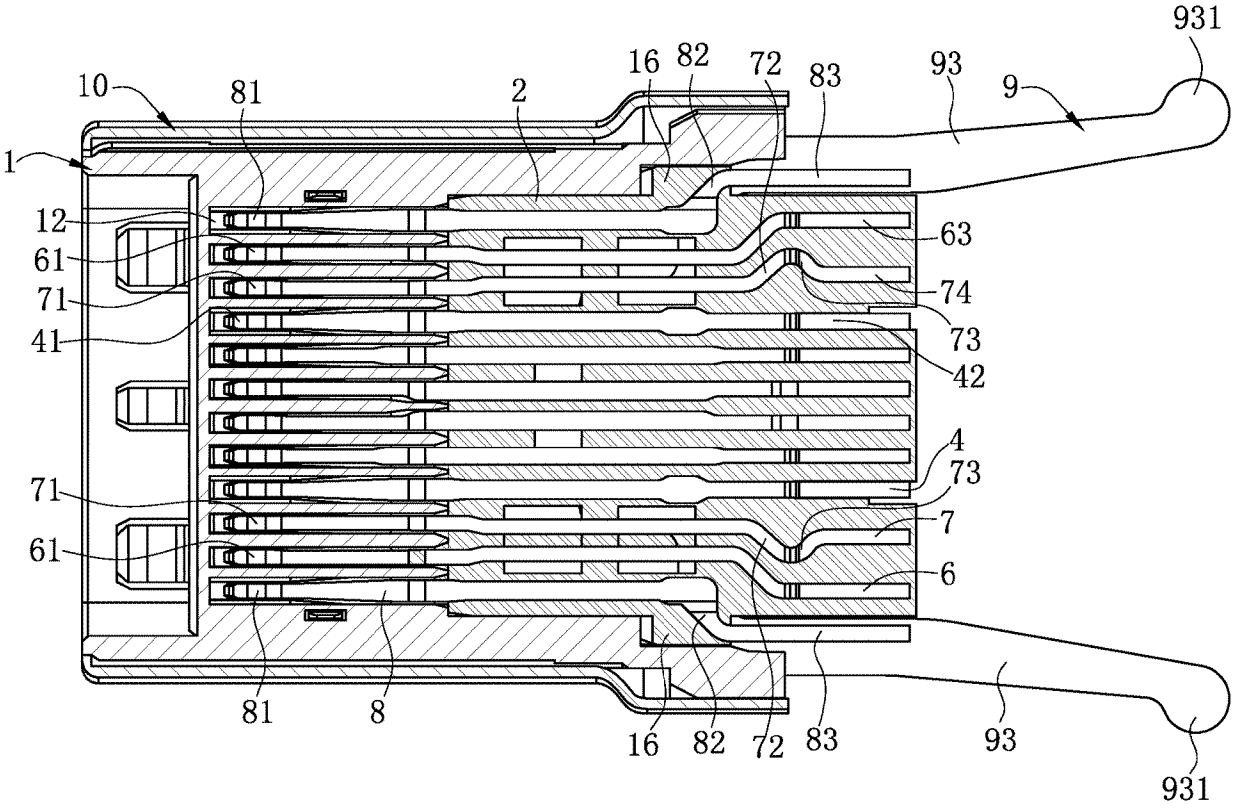
FIG. 4 is a sectional view of an electrical connector according to one embodiment of the present invention.
Figure 7:
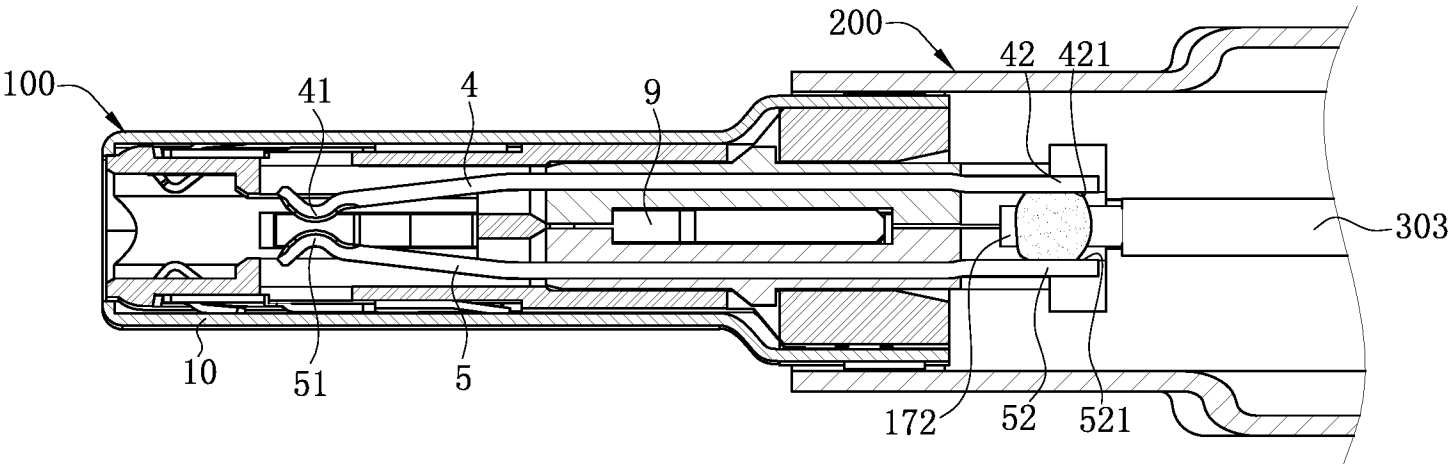
FIG. 7 is a sectional view showing a C-C direction of FIG. 5.

As shown in FIGS. 1, 4 and 7, the insertion cavity 11 is recessed backward from the front end of the insulating body 1. The insertion cavity 11 is used for receiving the tongue of the corresponding socket connector. The upper surface and the lower surface of the insulating body 1 are respectively provided with multiple terminal slots 12 communicated with the insertion cavity 11. The multiple terminal slots 12 are arranged in an upper row and a lower row on the insulating body 1. Two side walls of the insulating body 1 are respectively concavely provided with a hollow portion 14 communicated with the insertion cavity 11. A pair of shielding sheets 18 are respectively installed on the upper surface and the lower surface of the insulating body 1 and disposed at the front side of the terminal slot 12, and each shielding sheet 18 is provided with multiple elastic pieces stretching into the insertion cavity 11. The rear end of the insulating body 1 is recessed forward with a receiving cavity 13. The receiving cavity 13 is communicated with the terminal slots 12. The insulating body 1 has a center line along the front-rear direction, and the first terminal group E and the second terminal group F both have multiple terminals which are symmetrically distributed at two opposite sides of the center line.

Figure 5:
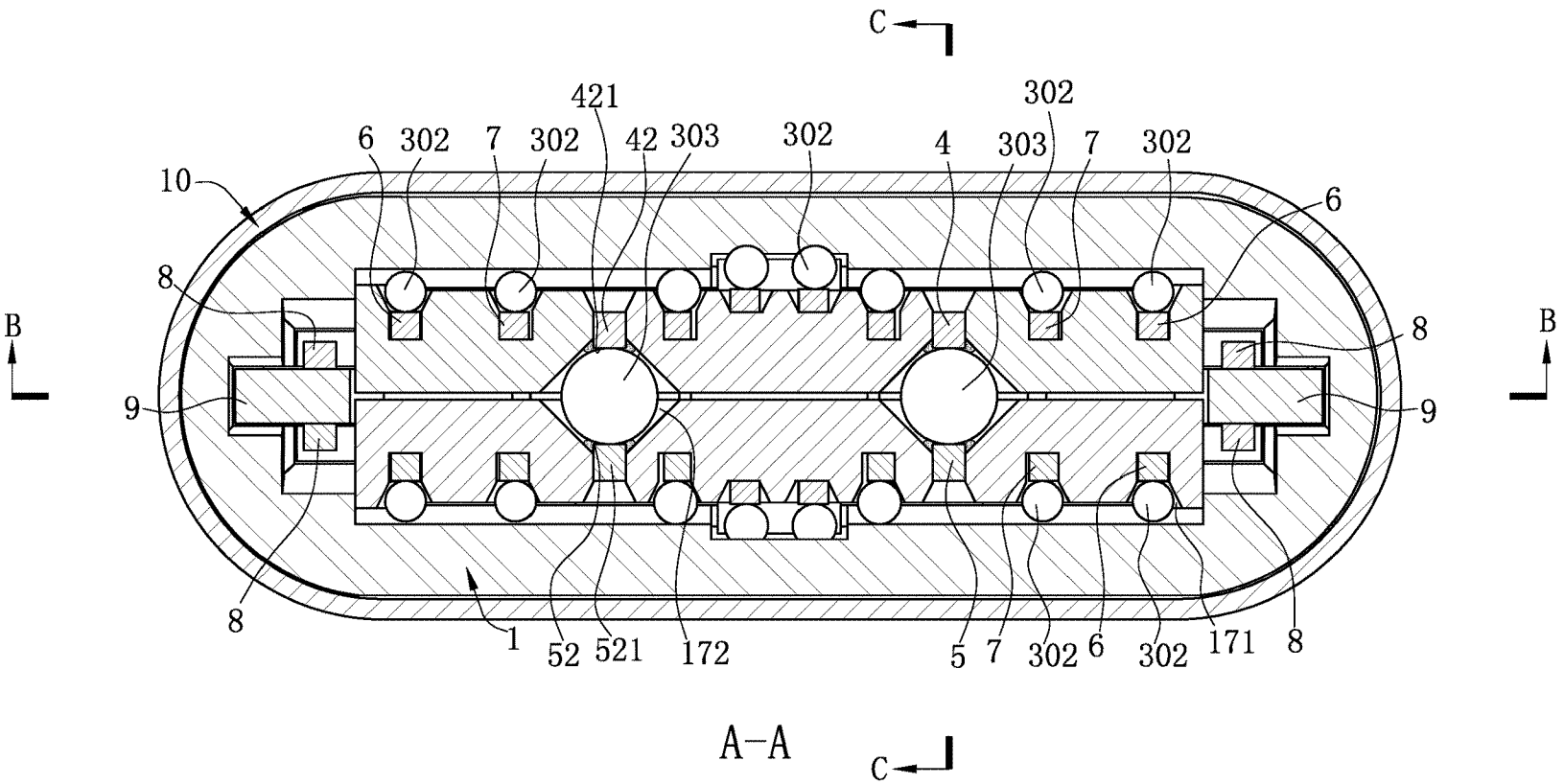
FIG. 5 is a section view showing an A-A direction of FIG. 2.

As shown in FIGS. 1, 4 and 5, the insulating body 1 is also provided with an upper terminal module and a lower terminal module therein. The upper terminal module includes an upper insulating block 2 and the first terminal group E which is integrally fixed on the upper insulating block 2 through insert molding. The lower terminal module includes a lower insulating block 3 and the second terminal group F which is integrally fixed on the lower insulating block 3 through insert molding. The lower insulating block 3 is provided with a fixed post 31 which is received and fixed in a fixed hole of the upper insulating block 2. Two sides of the upper insulating block 2 and the lower insulating block 3 are respectively transversely and convexly provided with a protruding portion 16, and the two protruding portions 16 of the upper insulating block 2 are in one-to-one correspondence to the two protruding portions 16 of the lower insulating block 3 in the vertical direction. The upper insulating block 2 and the lower insulating block 3 are installed together and then assembled into the insulating body 1 from rear to front. The front ends of the first terminal group E and the second terminal group F both correspondingly enter the terminal slots 12 and partially protrude into the insertion cavity 11 so as to be electrically connected to the connector socket. The front ends of the upper insulating block 2 and the lower insulating block 3 are fixed in the receiving cavity 13. The rear ends of the upper insulating block 2 and the lower insulating block 3 collectively form the placement platform 17. The upper surface of the upper insulating block 2 is the upper surface of the placement platform 17, and the lower surface of the lower insulating block 3 is the lower surface of the placement platform 17. The placement platform 17 protrudes out of the receiving cavity 13. The first terminal group and the second terminal group extend to the placement platform 17, and the placement platform 17 is used for placement of the cable 300, so that the cable 300 can be conveniently soldered to the first terminal group E and the second terminal group F. The upper surface and the lower surface of the placement platform 17 are respectively concavely provided with multiple wire arrangement slots 171 along the vertical direction. The cable 300 is provided with multiple core wires which are divided into two rows. The two rows of core wires are respectively received in the wire arrangement slots 171 of the upper surface and the lower surface of the placement platform 17 so as to be soldered to the first terminal group E and the second terminal group F. The placement platform 17 is provided with at least one open slot 172 throughout the upper surface and the lower surface of the placement platform 17. The open slot 172 is disposed between the wire arrangement slot 171 on the upper surface of the placement platform 17 and the wire arrangement slot 171 on the lower surface of the placement platform 17, and the open slot 172 is used for placement of one core wire of the cable 300. In the present embodiment, the placement platform 17 is provided with two open slots 172, the two open slots 172 are arranged in a separating manner and respectively penetrate through the upper insulating block 2 and the lower insulating block 3 along the vertical direction. In other embodiments, the placement platform 17 can also be provided with only one open slot 172 for placement of the core wire.

Figure 3:
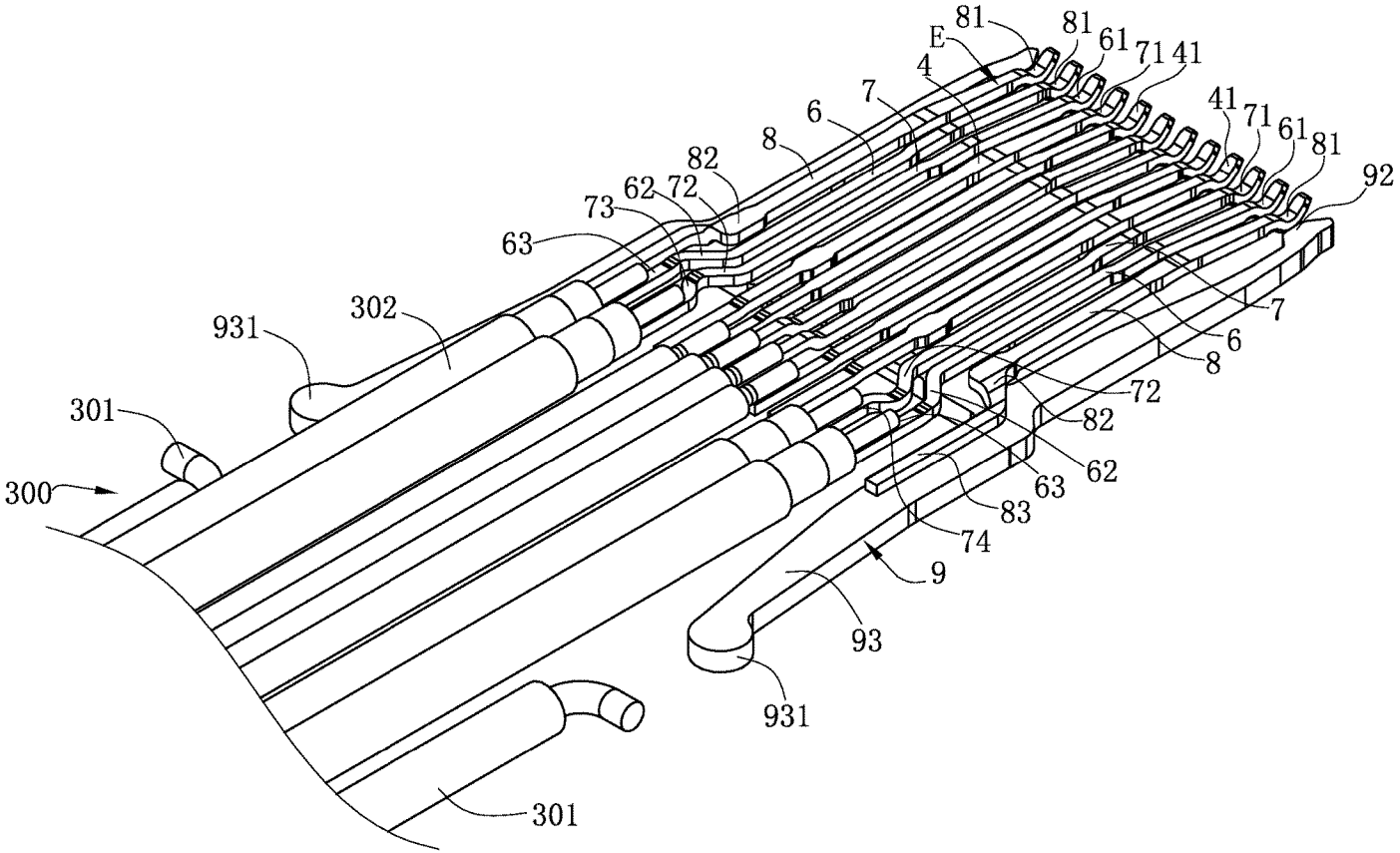
FIG. 3 is a schematic diagram of soldering a first terminal group and a cable according to one embodiment of the present invention.

As shown in FIGS. 3-5, the front ends of the first terminal group E and the second terminal group F are respectively disposed at the upper side and the lower side of the insertion cavity 11 so as to be arranged in an upper row and a lower row. The first terminal group E and the second terminal group F are arranged in a point symmetry by adopting a center point of the insertion cavity 11 as a symmetric center. In other words, the first terminal group E and the second terminal group F has a same number of terminals, the terminals are distributed in a diagonal symmetry, so that the connector socket can be inserted in dual orientation. The rear end of the first terminal group E is disposed on the upper surface of the placement platform 17 so as to be soldered to the cable 300, and the rear end of the second terminal group F is disposed on the lower surface of the placement platform 17 so as to be soldered to the cable 300. The first terminal group E and the second terminal group F are respectively provided with twelve terminals which are distributed in a same order as follows: a ground terminal 8 (GND), a first high-speed signal terminal 6 (SSTXp1), a second high-speed signal terminal 7 (SSTXn1), a power terminal (Vbus), a detection terminal (CC), a universal serial bus (USB) 2.0 terminal pair (D+, D−), a reserved terminal (Vconn), a power terminal (Vbus), a second high-speed signal terminal 7 (SSTXn1), a first high-speed signal terminal 6 (SSTXp1), and a ground terminal 8 (GND). The cable 300 is provided with a ground wire 301, a power wire 303 and signal wires 302 corresponding to the first terminal group E and the second terminal group F. In the present embodiment, the first core wire 303 is a power wire. In other embodiments, the first core wire 303 can be a ground wire or a signal wire, and the number of the first core wire 303 can be one or more. In the present embodiment, the electrical connector 100 is a USB TYPE C connector. In other embodiments, the electrical connector 100 can also be an input/output (IO)-type connector of other specifications. The number of the ground terminals 8 and the power terminals of the first terminal group can be one or more as long as the number corresponds to the multiple core wires of the cable 300.

As shown in FIGS. 1, 5 and 7, the first terminal group E includes at least one first terminal 4 which is correspondingly soldered to the first core wire 303. The second terminal group F includes at least one second terminal 5 which is correspondingly soldered to the first core wire 303. In the present embodiment, both the first terminal 4 and the second terminal 5 are power terminals, and the number of the first terminal 4 and the second terminal 5 is both two. In other embodiments, the first terminal 4 and the second terminal 5 can be the ground terminal or the signal terminal, and the number of the terminals can be one or more, as long as the number corresponds to the first core wire 303. One end of the first terminal 4 has an elastic first contacting portion 41 received in the terminal slot 12 and protruded into upper side of the insertion cavity 11 for urging with the connector socket. The other end of the first terminal 4 has a flat first soldering portion 42. The first soldering portion 42 is disposed in the wire arrangement slot 171 of the placement platform 17, and the bottom surface of the first soldering portion 42 has a first soldering surface 421 exposed to the open slot 172. One end of the second terminal 5 has an elastic second contacting portion 51 received in the terminal slot 12, and protruded into the lower side of the insertion cavity 11 for urging against the connector socket. The other end of the second terminal 5 has a second soldering portion 52 disposed opposite to the first soldering portion 42. The top surface of the second soldering portion 52 has a second soldering surface 521 disposed opposite to the first soldering surface 421. The second soldering surface 521 is exposed to the open slot 172. The first core wire 303 is inserted into the open slot 172 and disposed between the first soldering surface 421 and the second soldering surface 521, and the first core wire 303 is soldered to the first soldering surface 421 and the second soldering surface 521 through a solder material, so that the first soldering surface 421 and the second soldering surface 521 are firmly soldered together with the first core wire 303. The first core wire 303 is disposed and soldered between the first soldering surface 421 and the second soldering surface 521, and the first terminal 4 and the second terminal 5 having the same functions share one core wire, so that not only can the number of the first core wire 303 be reduced, but also no connecting piece is added for connecting the first terminal 4 and the second terminal 5, thereby effectively decreasing the manufacturing cost of the cable connector assembly. Further, the first terminal 4 and the second terminal 5 are directly soldered to the first core wire 303, so that the poor contact problem caused by allowing the first terminal 4 and the second terminal 5 to contact each other first and then to be soldered to the cable 300 can be avoided, and an effect of stable electrical connection between the first terminal 4 as well as the second terminal 5 and the cable 300 can be achieved.

As shown in FIG. 7, in the present embodiment, the second terminal 5 and the first terminal 4 are in alignment with each other in the vertical direction, and the second soldering surface 521 and the first soldering surface 421 are also in alignment with each other along the vertical direction. In other embodiments, the second terminal 5 and the first terminal 4 can also not be in alignment with each other in the vertical direction, and the first soldering portion 42 and the second soldering portion 52 are bent to make the first soldering surface 421 and the second soldering surface 521 parallel to each other along the horizontal direction. Projections of the first soldering surface 421 and the second soldering surface 521 in the horizontal direction are partially overlapped, and the first core wire 303 is soldered to the first soldering surface 421 and the second soldering surface 521 along the horizontal direction.

As shown in FIGS. 2-5, both the first terminal group E and the second terminal group F are provided with multiple signal terminals (not labeled), and a distance between the first soldering surface 421 and the second soldering surface 521 is smaller than the distance between the signal terminals of the first terminal group E and the corresponding aligned signal terminals of the second terminal group F. The multiple signal terminals include a first high-speed signal terminal 6 adjacent to the ground terminal 8 and a second high-speed signal terminal 7 adjacent to the first high-speed signal terminal 6. The first high-speed signal terminal 6 of the first terminal group E successively has a third contacting portion 61, a bending portion 62 and a third soldering portion 63 from front to rear. The third contacting portion 61 is received at the terminal slot 12 and protrudes into the insertion cavity 11. The bending portion 62 is fixed on the upper insulating block 2. The third soldering portion 63 is correspondingly disposed in the wire arrangement slot 171 of the placement platform 17 so as to be soldered to the signal wire 302. The bending portion 62 and the third contacting portion 61 are different in extending directions, and the bending portion 62 is horizontally deflected at an angle from the third contacting portion 61. The bending portion 62 and the third soldering portion 63 are disposed on a same plane, and the third soldering portion 63 and the third contacting portion 61 are parallel to each other. The second high-speed signal terminal 7 successively has a fourth contacting portion 71, a deviation portion 72, a reverse bending portion 73 and a fourth soldering portion 74 from front to rear. The fourth contacting portion 71 is received in the terminal slot 12 and protrudes into the insertion cavity 11. The deviation portion 72 and the reverse bending portion 73 are disposed on a same plane and fixed in the upper insulating block 2. The fourth soldering portion 74 and the third soldering portion 63 are disposed side by side in the wire arrangement slot 171 on the upper surface of the placement platform 17 so as to be soldered to the signal wire 302. The deviation portion 72 extends towards a direction close to the deflection direction of the bending portion 62, i.e., the deviation portion 72 and the bending portion 62 are identical in the deflection direction. The reverse bending portion 73 is deflected reversely from the deviation portion 72. The reverse bending portion 73 is deflected reversely from the deviation portion 72, so that a distance between the third soldering portion 63 and the fourth soldering portion 74 is increased, and a space for accommodating the cable 300 is increased, thereby facilitating the soldering of the signal wire 302, decreasing the production cost of the electrical connector 100 and simplifying the manufacturing process. Further, by arranging the reverse bending portion 73, the length of the second high-speed signal terminal 7 can be adjusted, so that the second high-speed signal terminal 7 and the first high-speed signal terminal 6 are kept equal in length, thereby reducing the signal time delay influence, and guaranteeing the high frequency effect of the electrical connector 100. The distance between the first soldering surface 421 and the second soldering surface 521 is smaller than the distance between the third soldering portion 63 of the first terminal group E and the corresponding third soldering portion 63 of the second terminal group F.

As shown in FIGS. 3-5, the first terminal group E and the second terminal group F both have two ground terminals 8. The two ground terminals 8 of the first terminal group E are respectively disposed at the outer side of the first high-speed signal terminal 6. The second terminal group F also has two ground terminals 8 respectively disposed at the outer side of the first high-speed signal terminal 6, and the two ground terminals 8 of the first terminal group E are in one-to-one correspondence to the two ground terminals 8 of the second terminal group F in the vertical direction. Each ground terminal 8 has a fifth contacting portion 81, a fifth soldering portion 83, and a transition portion 82 disposed between the fifth contacting portion 81 and the fifth soldering portion 83. The fifth contacting portion 81 protrudes into the insertion cavity 11. The transition portion 82 is deflected towards a direction away from the first high-speed signal terminal 6. By arranging the transition portion 82, the distance between the fifth soldering portion 83 and the third soldering portion 63 is increased, thereby facilitating the soldering of the signal wire 302 and the third soldering portion 63. Moreover, the fifth soldering portion 83 is disposed at the outer side of the placement platform 17 so as to urge against the latch member 9, and the fifth soldering portion 83 does not occupy the space of the placement platform 17, so that the space of the placement platform 17 is saved, and the placement platform 17 can accommodate more core wires. The transition portions 82 of the two ground terminals 8 of the first terminal group E are fixed at the protruding portions 16 of the upper insulating block 2, the transition portions 82 of the two ground terminals 8 of the second terminal group F are fixed at the protruding portions 16 of the lower insulating block 3, to further fix the ground terminals 8, so that the fifth soldering portion 83 firmly urges against the latch member 9. In the present embodiment, the first terminal group E and the second terminal group F both have two ground terminals 8; and in other embodiments, the number of the ground terminal 8 can be one or more.

Figure 6:
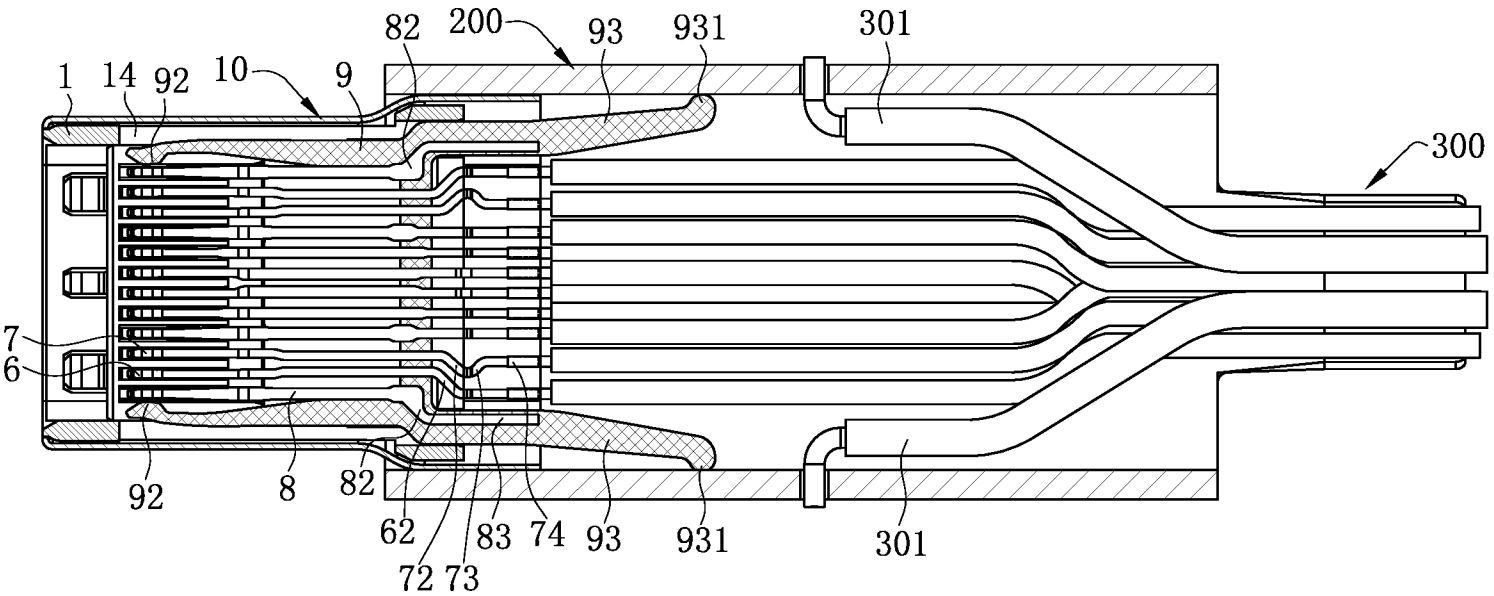
FIG. 6 is a section view showing an B-B direction of FIG. 5.

As shown in FIGS. 1, 4 and 6, the latch member 9 is arranged at the insulating body 1 and disposed between the first terminal group E and the second terminal group F. The latch member 9 is inserted into the insulating body 1 from rear to front, and the latch member 9 is clamped between the upper terminal module and the lower terminal module in the vertical direction. The latch member 9 has a base 91 fixed between the upper insulating block 2 and the lower insulating block 3. A pair of latch arms 92 respectively extends from two sides of the base 91, are received in the hollow portion 14, and extends into the insertion cavity 11. Each latch arm 92 is bent and extends backward to form an elastic arm 93 protruding out of the receiving cavity 13. A front section of the elastic arm 93 urges against the fifth soldering portions 83 at the upper side and the lower side to form electrical conduction, and one side of a rear section of the elastic arm 93 protrudes outwards to be provided with a conducting portion 931 which elastically urges against the inner wall surface of the second metal shell 200 so as to form electrical conduction, so that the ground terminal 8 and the latch member 9 are electrically connected to the second metal shell 200 to achieve a grounding effect, to reduce the resonance in the signal transmission process and to guarantee the transmission stability of a high frequency signal of the electrical connector 100. In the present embodiment, the ground wire 301 is soldered to the second metal shell 200, so that the ground terminal 8 is electrically connected to the ground wire 301. In other embodiments, the ground wire 301 can be directly soldered to the ground terminal 8 or the latch member 9 to form the electrical connection. In the present embodiment, the latch member 9 is integrally molded; and in other embodiments, the latch member 9 can also be molded in a splitting manner.

Figure 2:
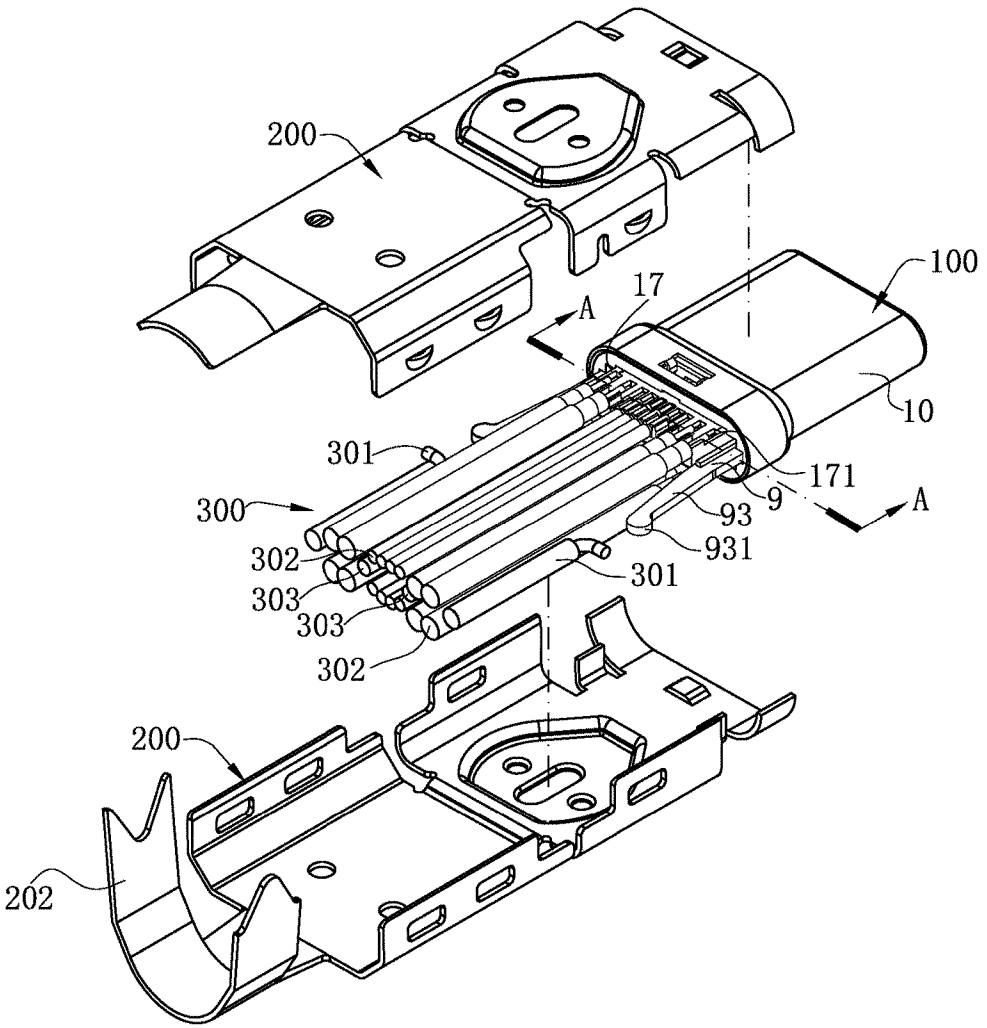
FIG. 2 is an partial assembly view of a cable connector assembly according to one embodiment of the present invention.

As shown in FIGS. 1, 2 and 6, the first metal shell 10 is in a cylindrical shape. The first metal shell 10 sleeves the periphery of the insulating body 1 from front to rear. The top surface and the bottom surface of the first metal shell 10 are respectively provided with a retaining sheet (not labeled) which is retained on the insulating body 1. The placement platform 17 protrudes out of the first metal shell 10, i.e., the wire arrangement slot 171 of the upper insulating block 2 and the wire arrangement slot 171 of the lower insulating block 3 respectively protrude out of the first metal shell 10.

As shown in FIGS. 1, 2 and 5, the front end of the second metal shell 200 wraps the rear end of the first metal shell 10, the wire arrangement slot 171 is disposed in the second metal shell 200, the elastic arm 93 is disposed in the second metal shell 200, and the conducting portion 931 urges against the second metal shell 200 to form a grounding circuit. A soldering hole 201 is formed in one side of the second metal shell 200, and the ground wire 301 is inserted in the soldering hole 201 so as to be soldered to the second metal shell 200, so that the ground terminal 8 is electrically connected to the ground wire 301. The rear end of the second metal shell 200 has a wire wrapping portion 202 wrapping the periphery of the cable 300, so that the electrical connector 100 and the cable 300 are integrally fixed.

Figure 8:
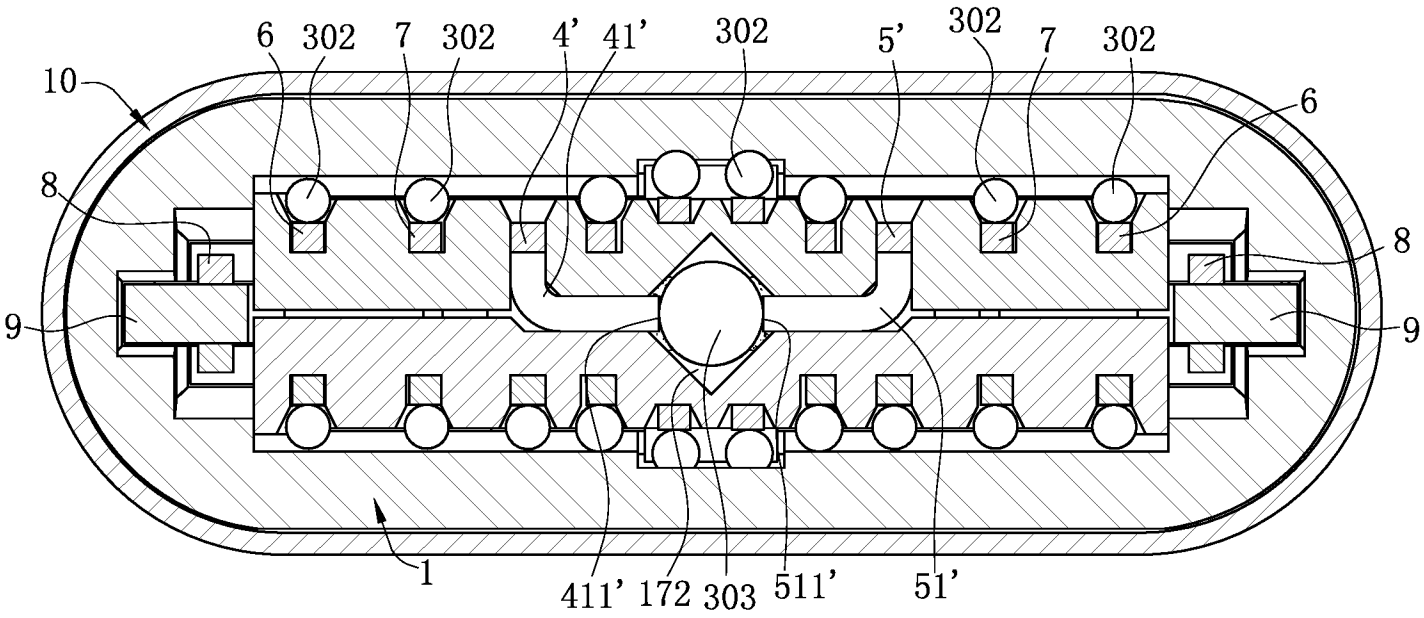
FIG. 8 is a sectional view of a second embodiment according to one embodiment of the present invention.

FIG. 8 shows a second embodiment of the preset invention which differs from the first embodiment in that: the first terminal group includes a first terminal 4' and a second terminal 5', the second terminal group doesn't include the first terminal 4' and the second terminal 5', the first terminal 4' and the second terminal 5' are disposed in the same row, the first terminal 4' doesn't has the first soldering portion 42, the second terminal 5' doesn't has the second soldering portion 52, one side of the rear end of the first terminal 4 is bent and extends to form a first extending sheet 41', the first extending sheet 41' is provided with the first soldering surface 411', one side of the rear end of the second terminal 5' is bent and extends towards the first extending sheet 41' to form a second extending sheet 51', the second extending sheet 51' is provided with the second soldering surface 511', the first core wire 303 is horizontally disposed between the first soldering surface 411' and the second soldering surface 511' and soldered to the first soldering surface 411' and the second soldering surface 511', i.e., the first terminal 4' and the second terminal 5' in the same row share one core wire, so that a purpose of reducing the number of the first core wire 303 and decreasing the manufacturing cost can be achieved. In the present embodiment, the first terminal 4' and the second terminal 5' in the same row share one core wire. In other embodiments, the first terminal 4' and the second terminal 5' disposed in different rows can also share one core wire, i.e., the two first terminals 4' are connected into a whole through a first bridging portion, the first bridging portion is provided with the first soldering surface 411', the two second terminals 5' are connected into a whole through a second bridging portion, the second bridging portion is provided with the second soldering surface 511', and the first core wire 303 is soldered to the first soldering surface 411' and the second soldering surface 511', i.e., the two first terminals 4' and the two second terminals 5' are collectively soldered to the first core wire 303, so that a purpose of reducing the number of the first core wire 303 and decreasing the manufacturing cost can also be achieved.

In summary, the cable connector assembly according to certain embodiments of the present invention has the following beneficial advantages:

(1) The first core wire 303 is disposed and soldered between the first soldering surface 421 and the second soldering surface 521, and the first terminal 4 and the second terminal 5 having the same functions share one core wire, so that not only can the number of the first core wire 303 be reduced, but also no connecting piece is added for connecting the first terminal 4 and the second terminal 5, thereby effectively decreasing the manufacturing cost of the cable connector assembly; and moreover, the first terminal 4 and the second terminal 5 are directly soldered to the first core wire 303, so that the poor contact problem caused by allowing the first terminal 4 and the second terminal 5 to first contact each other and then to be soldered to the cable 300 can be avoided, and an effect of stable electrical connection between the first terminal 4 as well as the second terminal 5 and the cable 300 can be achieved.

(2) The reverse bending portion 73 is deflected reversely from the deviation portion 72, so that the distance between the third soldering portion 63 and the fourth soldering portion 74 is increased, and the space for accommodating the cable 300 is increased, thereby facilitating the soldering of the signal wire 302, decreasing the production cost of the electrical connector 100, and simplifying the manufacturing process; and furthermore, by arranging the reverse bending portion 73, the length of the second high-speed signal terminal 7 can be adjusted, so that the second high-speed signal terminal 7 and the first high-speed signal terminal 6 are kept equal in length, thereby reducing the signal time delay influence, and guaranteeing the high frequency effect of the electrical connector 100.

(3) The transition portion 82 is deflected towards the direction away from the first high-speed signal terminal 6, the fifth soldering portion 83 extends backwards from the transition portion 82, and by arranging the transition portion 82, the distance between the fifth soldering portion 83 and the third soldering portion 63 is increased, thereby facilitating the soldering of the signal wire 302 and the third soldering portion 63; and moreover, the fifth soldering portion 83 is disposed at the outer side of the placement platform 17 so as to urge against the latch member 9, and the fifth soldering portion 83 does not occupy the space of the placement platform 17, so that the space of the placement platform 17 is saved, and the placement platform 17 can accommodate more core wires.

(4) Each latch arm 92 is bent and extends backwards to form the elastic arm 93 protruding out of the receiving cavity 13 and urging against the fifth soldering portions 83 at the upper side and the lower side to form the electrical conduction; and one side of the rear section of the elastic arm 93 is outwards convexly provided with a conducting portion 931 which elastically urges against the inner wall surface of the second metal shell 200 so as to form the electrical conduction, so that the ground terminal 8 and the latch member 9 are electrically connected to the second metal shell 200 to achieve the grounding effect, to reduce the resonance in the signal transmission process, and to guarantee the transmission stability of a high-frequency signal of the electrical connector 100.

(5) The transition portions 82 of the two ground terminals 8 of the first terminal group E are fixed at the protruding portions 16 of the upper insulating block 2, the transition portions 82 of the two ground terminals 8 of the second terminal group F are fixed at the protruding portions 16 of the lower insulating block 3, and the ground terminals 8 are further fixed, so that the fifth soldering portion 83 firmly urges against the latch member 9.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable connector assembly, comprising:

an electrical connector, comprising:

an insulating body; and a first terminal group and a second terminal group respectively received in the insulating body and arranged in an upper row and a lower row, wherein the first terminal group has at least one first terminal, the first terminal has a first contacting portion at one end thereof and a first soldering portion at the other end thereof, the first soldering portion has a first soldering surface, the second terminal group has at least one second terminal, the second terminal has a second contacting portion at one end thereof and a second soldering portion at the other end thereof, and the second soldering portion has a second soldering surface disposed opposite to the first soldering surface; and a cable comprising a plurality of core wires soldered to the first terminal group and the second terminal group, wherein the cable has at least one first core wire disposed between the first soldering surface and the second soldering surface and soldered to the first soldering surface and the second soldering surface.

2. The cable connector assembly of claim 1, wherein each of the first terminal group and the second terminal group comprises a plurality of signal terminals, and a distance between the first soldering surface and the second soldering surface is smaller than a distance between one of the signal terminals of the first terminal group and corresponding one of the signal terminals of the second terminal group.

3. The cable connector assembly of claim 1, wherein the second terminal is in alignment with the first terminal in a vertical direction, the second terminal and the first terminal both are power terminals, and the at least one first core wire is a power wire.

4. The cable connector assembly of claim 1, wherein the first soldering surface and the second soldering surface urge against the at least one first core wire respectively from a top side and a bottom side, and projections of the first soldering surface and the second soldering surface in a horizontal plane are partially overlapped.

5. The cable connector assembly of claim 1, wherein the first terminal group and an upper insulating block are integrally insert-molded, the second terminal group and a lower insulating block are integrally insert-molded, a rear end of the insulating body is recessed forward with a receiving cavity, the upper insulating block and the lower insulating block are installed together and then assembled into the receiving cavity to form a placement platform protruding out of a rear end of the receiving cavity, the core wires are divided into two rows to be respectively distributed on an upper surface and a lower surface of the placement platform so as to be soldered to the first terminal group and the second terminal group, and the at least one first core wire is disposed between the two rows of core wires and soldered to the first soldering surface and the second soldering surface.

6. The cable connector assembly of claim 5, wherein the placement platform is provided with at least one open slot along a vertical direction, both the first soldering surface and the second soldering surface are exposed to the open slot, and the first core wire is inserted into the open slot to be soldered to the first soldering surface and the second soldering surface.

7. The cable connector assembly of claim 5, wherein each of the first terminal group and the second terminal group are provided with at least one ground terminal and a plurality of signal terminals, the cable further comprises at least one ground wire and a plurality of signal wires, the upper surface and the lower surface of the placement platform are respectively recessed with a plurality of wire arrangement slots along a vertical direction, the signal wires are correspondingly received in the wire arrangement slots so as to be soldered to the signal terminals, and the ground wire is disposed at the outer side of the placement platform so as to be soldered to the ground terminal.

8. The cable connector assembly of claim 7, wherein the signal terminals comprise a first high-speed signal terminal adjacent to the ground terminal and a second high-speed signal terminal adjacent to the first high-speed signal terminal, the first high-speed signal terminal successively has a third contacting portion, a bending portion and a third soldering portion from front to rear, the bending portion and the third contacting portion are different in extending directions, the bending portion and the third soldering portion are disposed on a same plane, the second high-speed signal terminal successively has a fourth contacting portion, a deviation portion, a reverse bending portion and a fourth soldering portion from front to rear, the deviation portion extends toward a direction close to a deflection direction of the bending portion, the reverse bending portion is deflected reversely from the deviation portion and is disposed on a same plane with the deviation portion, and the third soldering portion and the fourth soldering portion are both disposed on the placement platform to be soldered to the signal wire.

9. The cable connector assembly of claim 8, wherein each of the first terminal group and the second terminal group comprises two ground terminals, each of the ground terminals has a fifth contacting portion at a front end thereof, a fifth soldering portion at a rear end thereof, and a transition portion disposed between the fifth contacting portion and the fifth soldering portion, the transition portion is deflected towards a direction away from the first high-speed signal terminal, and the deflection direction of the transition portion is opposite to the deflection direction of the reverse bending portion.

10. The cable connector assembly of claim 9, wherein two sides of each of the upper insulating block and the lower insulating block are respectively transversely and convexly provided with a protruding portion, and each of the protruding portions correspondingly wraps and fixes corresponding one of the transition portions of the ground terminals.

11. The cable connector assembly of claim 1, wherein each of the first terminal group and the second terminal group comprises at least one ground terminal, a latch member is arranged on the insulating body and disposed between the first terminal group and the second terminal group, and the ground terminals of the first terminal group and the second terminal group are in electrical contact with the latch member.

12. The cable connector assembly of claim 11, further comprising a first metal shell and a second metal shell, wherein the first metal shell sleeves the insulating body, one end of the second metal shell wraps the periphery of the first metal shell, the other end of the second metal shell wraps and fixes the cable, the second metal shell urges against at least one of the ground terminals and the latch member, the cable comprises at least one ground wire, and the ground wire is soldered to at least one of the ground terminals, the latch member and the second metal shell.

13. The cable connector assembly of claim 12, wherein a front end of the insulating body is recessed with an insertion cavity, the latch member has a pair of latch arms entering the insertion cavity, each of the latch arms extends backward to form an elastic arm protruding out of the insulating body, a front section of each of the elastic arms urge against the ground terminals of the first terminal group and the second terminal group, a rear section of each of the elastic arms is convexly provided with a conducting portion elastically urging against an inner wall surface of the second metal shell, and the ground wire is soldered to the second metal shell.

14. A cable connector assembly, comprising:

an electrical connector, comprising an insulating body, and at least one first terminal and at least one second terminal received in the insulating body, wherein the first terminal has a first contacting portion at one end thereof and a first soldering surface at the other end thereof, the second terminal has a second contacting portion at one end thereof and a second soldering surface at the other end thereof and disposed opposite to the first soldering surface; and a cable, comprising at least one first core wire, wherein the first core wire is disposed between the first soldering surface and the second soldering surface and soldered to the first soldering surface and the second soldering surface.

15. The cable connector assembly of claim 14, wherein a front end of the insulating body is recessed backward with an insertion cavity, the first terminal and the second terminal are respectively disposed at an upper side and a lower side of the insertion cavity, and projections of the first soldering surface, the first core wire and the second soldering surface in a vertical direction are overlapped.

16. The cable connector assembly of claim 14, wherein a plurality of signal terminals are arranged in an upper row and a lower row on the insulating body, and a distance between the first soldering surface and the second soldering surface is smaller than a distance between one of the signal terminal disposed in the upper row and corresponding one of the signal terminals disposed in the lower row.

17. The cable connector assembly of claim 16, wherein a rear side of the insulating body is convexly provided with a placement platform, an upper surface and a lower surface of the placement platform are respectively concavely provided with a plurality of wire arrangement slots along a vertical direction, the cable comprises a plurality of signal wires which are respectively disposed in the wire arrangement slots so as to be soldered to the signal terminals, the placement platform is provided with at least one open slot throughout the upper surface and the lower surface of the placement platform, the first soldering surface and the second soldering surface are both exposed to the open slot, and the first core wire is inserted into the open slot to be soldered to the first soldering surface and the second soldering surface.

18. The cable connector assembly of claim 14, wherein a front end of the insulating body is recessed backward with an insertion cavity, the first terminal and the second terminal are disposed at a same side of the insertion cavity, one side of a rear end of the first terminal is bent and extends to form a first extending sheet, the first extending sheet is provided with the first soldering surface, one side of a rear end of the second terminal is bent and extends towards the first extending sheet to form a second extending sheet, the second extending sheet is provided with the second soldering surface, and the first core wire is horizontally disposed between the first soldering surface and the second soldering surface.

19. The cable connector assembly of claim 14, wherein a number of the first terminals and a number of the second terminals is both two, a first bridging portion is provided between the two first terminals, the two first terminals are connected into a whole through the first bridging portion, the first bridging portion is provided with the first soldering surface, a second bridging portion is provided between the two second terminals, the two second terminals are connected into a whole through the second bridging portion, the second bridging portion is provided with the second soldering surface, and the first core wire is disposed between the first bridging portion and the second bridging portion and soldered to the first soldering surface and the second soldering surface.

20. The cable connector assembly of claim 14, wherein the second terminal and the first terminal are both power terminals and are in alignment with each other along a vertical direction, and the first core wire is a power wire.

* * * * *